US007732059B2

(12) United States Patent
Ren et al.

(10) Patent No.: US 7,732,059 B2
(45) Date of Patent: Jun. 8, 2010

(54) HEAT EXCHANGER TUBING BY CONTINUOUS EXTRUSION

(75) Inventors: Baolute Ren, Lititz, PA (US); Raymond J. Kilmer, Lancaster, PA (US); John F. Butler, Jr., Lititz, PA (US)

(73) Assignee: Alcoa Inc., Pittsburgh, PA (US)

( * ) Notice: Subject to any disclaimer, the term of this patent is extended or adjusted under 35 U.S.C. 154(b) by 1298 days.

(21) Appl. No.: 11/157,668

(22) Filed: Jun. 21, 2005

(65) Prior Publication Data

US 2006/0118282 A1 Jun. 8, 2006

Related U.S. Application Data

(60) Provisional application No. 60/633,076, filed on Dec. 3, 2004.

(51) Int. Cl.
*B32B 15/20* (2006.01)
*B32B 15/02* (2006.01)

(52) U.S. Cl. ..... 428/654; 148/439; 420/528; 165/905

(58) Field of Classification Search ..... None
See application file for complete search history.

(56) References Cited

U.S. PATENT DOCUMENTS

| | | | | |
|---|---|---|---|---|
| 3,765,216 | A | 10/1973 | Green | |
| 4,238,248 | A * | 12/1980 | Gyongyos et al. | 148/551 |
| 5,000,025 | A | 3/1991 | Beekel | 72/259 |
| 5,015,439 | A | 5/1991 | Tyler et al. | 419/23 |
| 5,353,639 | A | 10/1994 | Brookins et al. | 72/363 |
| 5,514,228 | A * | 5/1996 | Wyatt-Mair et al. | 148/551 |
| 5,634,991 | A * | 6/1997 | Kamat | 148/551 |
| 5,976,278 | A * | 11/1999 | Sircar | 148/550 |
| 6,059,902 | A * | 5/2000 | Yoshihara et al. | 148/550 |
| 6,391,127 | B1 * | 5/2002 | Wyatt-Mair et al. | 148/551 |
| 6,458,224 | B1 * | 10/2002 | Ren et al. | 148/437 |
| 6,500,284 | B1 * | 12/2002 | Zhou et al. | 148/551 |
| 6,503,446 | B1 | 1/2003 | Ren et al. | |
| 6,536,255 | B2 | 3/2003 | Kraft | 72/256 |
| 6,602,363 | B2 | 8/2003 | Ren | |
| 6,656,296 | B2 | 12/2003 | Ren et al. | |
| 6,660,107 | B2 | 12/2003 | Ren | |
| 6,739,387 | B1 | 5/2004 | Ren | 165/176 |
| 2004/0086417 | A1 * | 5/2004 | Baumann et al. | 420/531 |

(Continued)

FOREIGN PATENT DOCUMENTS

DE 3810261 A1 3/1988

(Continued)

OTHER PUBLICATIONS

Journal—Rudy I Metale Niezelazne(Enclosed), Nov. 1998.

(Continued)

*Primary Examiner*—John J Zimmerman
(74) *Attorney, Agent, or Firm*—Greenberg Traurig, LLP

(57) ABSTRACT

A heat exchanger tube having enhanced corrosion resistance and improved resistance to high burst pressures. The heat exchanger tube comprises an aluminum alloy that consists essentially of about 0.01-1.5% silicon, up to about 1.2% copper, up to about 2.0% manganese, about 0.01-1.0% iron, about 0.01-5.0% zinc, up to about 0.02% titanium and the balance substantially aluminum and incidental elements and impurities.

23 Claims, 3 Drawing Sheets

U.S. PATENT DOCUMENTS

| | | | | |
|---|---|---|---|---|
| 2005/0126745 | A1 * | 6/2005 | Bowles et al. | 164/490 |
| 2006/0088438 | A1 * | 4/2006 | Corrigan et al. | 420/532 |
| 2006/0196635 | A1 * | 9/2006 | Lesage | 165/76 |

FOREIGN PATENT DOCUMENTS

| | | | | |
|---|---|---|---|---|
| JP | 59-143039 | * | 8/1984 | |
| JP | 2002-294383 | * | 10/2002 | |
| WO | WO 9117002 | | 3/1991 | 516/749 |

OTHER PUBLICATIONS

Journal—Light Metal Age (Enclosed), Aug. 1995.
Journal—Extrusion Goes Continuous; process Promises Economies (Enclosed), Dec. 1984.
Journal—CME Chartered Mechanical Engineer (Enclosed), Feb. 1984.
Article—Tube Manufacture by the 'Conform' Process, Sep. 1982.
Conference Paper—5th International Aluminum Extrusion Technology Seminar, vol. II (Table of Contents), including "New Develoments in Conform Technology for Continuous Extrusion", pp. 413-419, and "The Development of Microstructure and the Consolidation of RSP Aluminum Alloys in Conform Extrusion", pp. 427-438, 1977.
Journal—Fils Bandes Profiles, Paris, Apr. 21-22, 1977.
A Review of the Confex Continuous Non Ferrous Extrusion Process, by David Godwin, Confex Technology, Ltd., pp. 571-577, 1998.

* cited by examiner

HEAT EXCHANGER TUBING BY CONTINUOUS EXTRUSION

CROSS REFERENCE TO RELATED APPLICATIONS

This application claims the benefit of U.S. Provisional Application Ser. No. 60/633,076, filed on Dec. 3, 2004, the disclosure of which is fully incorporated by reference herein.

FIELD OF THE INVENTION

The present invention relates to a single and multiple layer aluminum tube and a method for economically fabricating such a tube. More specifically, this invention discloses a method for manufacturing aluminum tube products with thin walls and fine features, such as micro multi void tubing, used in the manufacture of heat exchangers.

BACKGROUND OF THE INVENTION

Aluminum heat exchangers are used widely in the automotive industry. Applications include engine cooling systems where heat exchangers such as radiators, oil coolers, charge air coolers and the like are employed. Additionally, passenger climate control systems also utilize heat exchangers as evaporators and condensers. Air conditioning systems typically have two heat exchangers: condensers and evaporators. Condensers typically operate at elevated pressures (>500 psi) and most typically are made with extruded tubes. These tubes are produced via traditional methods of extrusion. Most radiators use tubes made from welded or folded sheet (in part, due to the elevated costs per unit length of extruded tubes versus tubes made from sheet and in part as a result of the lower system pressure requirements of radiators (typically 20 psi or less)). However, some radiator tubes are also manufactured by extrusion processes depending on the design and specific durability requirements of the radiator in the field.

Typical extrusion based heat exchangers come essentially in two designs. The first design uses round tubing and bare (i.e. uncladed) fins that are mechanically attached to the round tubes by first lacing the tubes into holes punched in the fins, and then expanding the tubes to ensure that the tube's outer surface is in close mechanical contact with the fins.

The second typical design uses flat tubing having a plurality of channels in the tubing, commonly referred to as multi void tubing or micro multi void tubing. This type of heat exchanger tubing is attached to the fins using a brazing process. The cross section of the flow channels can vary, e.g., circular, oval, square, rectangular, of other regular or irregular shapes. Typically, micro multi void and multi void tubing are about 10-60 mm in width and about 1-2 mm in height.

Most aluminum extruded tubing products made for heat exchanger systems are produced by using traditional billet extrusion methods, such as press extrusion. As the alloy strength increases, the ability to use these traditional methods of extrusion becomes less feasible due to the difficulty of extruding the high strength alloy into a small tube. This difficulty occurs because as the dimensions of the heat exchanger tube decreases, the extrusion ratio, which is defined by a ratio of container bore area and the total cross sectional area of extrusion, increases thereby increasing the extrusion pressure needed to extrude the heat exchanger tube. The end result is that it is difficult (or sometimes not possible) and at the least, very expensive to produce fine dimensioned tubing from high strength materials using traditional extrusion methods. This is becoming a barrier to the introduction of newer heat exchanger designs that utilize fine dimensioned tubing, particularly for next generation designs where tubing must withstand very high pressures, for example $CO_2$ refrigerant systems. In addition, as the heat exchanger manufacturers continue to work on next generation designs there is an increasing need for thin walled tubing with finer features that has high strength and high corrosion resistance, and in some instance high strength at elevated service temperature. Therefore, heat exchanger tubing might soon be required to operate at significantly higher pressures while at the same time becoming smaller in size as compared to current heat exchanger designs with tubes that use R-134a as the refrigerant. In order to meet these increasing demands in a cost effective manner, it is critical that the heat exchanger tubes be extruded from higher strength alloys.

Therefore, there exists a need for an improved high strength heat exchanger tube that can withstand high burst pressures, exhibit good corrosion resistance, have small dimensions (e.g. 10 mm by 1 mm MMV tubing with micro void width less than 1 mm), and have fine internal features. Additionally, there exists a need for a process to economically fabricate such a tube.

A continuous rotary extrusion process, known as the Conform™ Process, was developed and patented (U.S. Pat. No. 3,765,216) by the United Kingdom Atomic Energy Authority. In the Conform™ Process a rod or particulate feedstock replaces the extrusion billet and thereby making the extrusion process continuous. The equipment used in the Conform™ Process includes a grooved wheel, a coining roll, an abutment, a close fitting shoe, and an extrusion die. During the extrusion process the feedstock is fed into a space formed by the grooved wheel, close fitting shoe, and abutment, and is heated and pressurized by the friction between the rotating wheel and metal. When the metal temperature is sufficiently high the pressure extrudes the metal through the extrusion die.

For high volume aluminum tubing production requiring high productivity (lbs/hr), capital investment generally has not particularly favored the Conform™ process (vs. the traditional billet extrusion process) because of developed multi-out capabilities of billet extruders (sometimes up to 8 out) and differences in market pricing for feedstock rod vs. billet (i.e. billet is generally cheaper per pound for a specific alloy). Furthermore, it is a general perception in the industry that the Conform™ process is more appropriate for simple, larger tolerance, less demanding shapes made from easy to extrude alloys like AA1060 for products such as spacer bars and the like. Hence the overwhelming majority of tubing is produced today via traditional billet based extrusion processes.

However, the Conform™ process can make certain shapes with certain metallurgical structures that billet based process cannot make due to the process differences between the two processes, namely due to the differences in metallurgical structure of the rodstock and the reduced extrusion ratios (and resulting constancy of the die face pressure) of the Conform™ process.

Thus, there is a problem in the art, associated with the difficulty in extruding a small tube having a relatively complex structure, such as a micro multi void tubing, from a material with a high flow stress because the small tubing size increases the extrusion ratio, i.e. the cross sectional area ratio between the billet and the extruded product. This in turn increases the tonnage of pressure needed to extrude the alloy into the desired shape and dimension, and effectively limits the alloy chemistries that can be chosen as well as the allowable base microstructure of the metal being extruded to microstructures that have low flow stresses. Hence billets are generally homogenized prior to extrusion, solute contents are generally low, and the billets are generally DC cast and preheated immediately prior to extrusion process.

SUMMARY OF THE INVENTION

The present invention is a response to the need for an improved heat exchanger tube, providing a method for producing an improved aluminum or heat exchanger tube at reduced costs and reduced manufacturing times while utilizing higher strength alloys. The invention is further directed to a heat exchanger tube having improved resistance to high burst pressures.

The heat exchanger tube is comprised of an aluminum alloy that consists essentially of about 0.01-1.5% silicon, up to about 1.2% copper, up to about 2.0% manganese, about 0.01-1.0% iron, up to about 5.0% zinc, up to about 0.02% titanium, and the balance substantially aluminum and incidental elements and impurities. The aluminum alloy can further contain one or more of the following elements: about 0.01-0.35% chromium, about 0.01-0.35% zirconium, about 0.01-0.35% vanadium, about 0.01-0.35% cobalt, up to about 1.0% magnesium, and about 0.01-2.5% nickel. The aluminum alloy is a feedstock that can be fabricated using processes that are commonly known in the art.

In one embodiment, the feedstock can also be fabricated using a continuously cast process. The feedstock could be a strip, rod, or sheet having an aspect ratio ranging from about 1:1 to 500:1. The feedstock may also be exposed to elevated temperatures greater than about 300° C. The feedstock has an average secondary dendrite arm spacing of less than about 100 microns, has a cross sectional area of about 2500 $mm^2$ or less and has a yield strength ranging from about 50 to about 150 MPa. The feedstock is then extruded using a continuous rotary extrusion process.

After extrusion, the extrusion (e.g. heat exchanger tube) can be quenched using quenching processes that are commonly known in the art, such as still air cooling, force air cooling, spray water cooling, immersion in water, spray coolant cooling or immersion in coolant.

In one embodiment, the heat exchanger tube can further comprise a zinc coating of at least about 80 wt % zinc that is located on the exterior surface of the tube. The zinc coating can be applied to the exterior surface by coating processes that are commonly known in the art such as thermal spray, chemical vapor deposition, physical vapor deposition, cold spray or other metal deposition systems.

In one embodiment, the heat exchanger tube has a circumference less than about 400 mm.

In one embodiment, the heat exchanger tube is a micro multi void tube with a maximum height not exceeding about 5 mm.

In one embodiment, one or more walls of the heat exchanger tube have a wall thickness of less than about 1 mm.

In one embodiment, the heat exchanger tube has a post brazed tensile yield strength that exceeds about 35 MPa, preferably said tube has a post brazed tensile yield strength that exceeds about 45 MPa.

In one embodiment, the heat exchanger tube can withstand a burst pressure greater than about 69 bar. Similarly, the post braze heat exchanger tube can also withstand a burst pressure greater than about 69 bar.

In one embodiment, the heat exchanger tube could have an electric conductivity that is above 48% IACS (International Annealed Copper Standard). The post braze heat exchanger tube could have an electric conductivity that is above 48% IACS.

In one embodiment, the invention is directed to a multi layered extruded tube having improved resistance to high burst pressures. The multi layered tube has an inner core tube comprising an aluminum alloy consisting essentially of about 0.01-1.5% silicon, up to about 1.2% copper, up to about 2.0% manganese, about 0.01-1.0% iron, up to about 5.0% zinc, up to about 0.02% titanium, and the balance substantially aluminum and incidental elements and impurities, and one or more clad layers comprising an aluminum alloy selected from the group consisting essentially of the 1XXX, 2XXX, 3XXX, 4XXX, 5XXX, 6XXX, 7XXX, and 8XXX series of aluminum alloys cladded on an exterior surface of said inner core. The inner core tube can further contain one or more of the following elements: about 0.01-0.35% chromium, about 0.01-0.35% zirconium, about 0.01-0.35% vanadium, about 0.01-0.35% cobalt, up to about 1.0% magnesium and about 0.01-2.5% nickel.

In one embodiment, the aluminum alloy used for the inner core is a feedstock that can be fabricated using processes that are commonly known in the art. The feedstock can also be fabricated using a continuously cast process. The feedstock could be a strip, rod, or sheet having an aspect ratio ranging from about 1:1 to 500:1. The feedstock may also be exposed to elevated temperatures greater than about 300° C. The feedstock has an average secondary dendrite arm spacing of less than about 100 microns, has a cross sectional area of about 2500 $mm^2$ or less and has a yield strength ranging from about 50 to about 150 MPa. The feedstock is then extruded using a continuous rotary extrusion process into an extrusion.

After extrusion, the extrusion (e.g. inner core tube) can be quenched using quenching process processes that are commonly known in the art such as still air cooling, forced air cooling, spray water cooling, immersion in water, spray coolant cooling or immersion in coolant.

One or more tangential continuous rotary extrusion machines is used to clad one or more clad layers onto the exterior surface of the inner core tube.

After cladding, one or more of the cladded layers can be drawn or sinked over the inner core tube.

The multi layered extruded tube can further comprise a zinc coating of at least about 80 wt % zinc that is located on the exterior surface of the tube. The zinc coating can be applied to the exterior surface by coating processes that are commonly known in the art such as thermal spray, chemical vapor deposition, physical vapor deposition, cold spray or other metal deposition systems.

One or more of the clad layers in the multi layered extruded tube can be selected from the Aluminum Association's 4343, 4045 and 4047 aluminum alloys, and have a thickness ranging from about 3 μm to about 300 μm.

One clad layer could have an electrochemical potential difference of at least about 20 mV to about 40 mV (positive or negative) when compared to the inner core tube or an adjacent clad layer as defined by the ASTM G69 standard.

The multi layered extruded tube can be a micro multi void heat exchanger tube having a circumference less than about 400 mm and a height not exceeding about 5 mm.

The feedstock is fabricated by using, but not limited to, continuous casting followed by warm and cold work into rod, bar, plate, sheet, and other shapes that are used for the Conform™ Process. (While it is possible to fabricate feedstock from DC (direct chill) based ingot process, it is generally more costly and the slower solidification rates are generally less advantageous). The continuous casting process is controlled such that the metallurgical structure is obtained to meet the physical, electrochemical, and mechanical property requirements for the extruded tube products. For instance, the composition and solidification process can be controlled such that the alloy has high solute in solid solution, fine particles for dispersoids strengthening, and balanced electrochemical potentials between particles and matrix for excellent corrosion resistance. The stock is thermally treated or non-thermally treated according to the property requirements of the final product, which typically include mechanical properties, corrosion resistance, fatigue resistance, etc. For example, it is possible to form after braze, in the area where the extrusions come in contact with molten 4xxx braze cladding, a dispersoid band of $Al_{12}(Fe,Mn)_3Si$ particles in a low (<0.1%) Si 3003 type alloy after brazing, if the stock is not homogenized prior to rotary extrusion. This post-brazed microstructure has been shown to be highly corrosion resistant in splash type environment in cars such as sheet based heat exchangers like radiators.

The continuous cast feedstock properties, such as dispersoid populations or solute contents in solid solution, can be nearly retained in the final product due to a short thermal cycle in the Conform™ Process. In the billet extrusion process, the billets are almost always homogenized and then heated up to extrusion temperature before extrusion. During the billet homogenization, cooling after homogenization and extrusion preheat processes some alloying elements in the billet precipitate. The solute precipitation changes the billet's metallurgical structure and the resultant properties of final products. The Conform™ process itself does not rely on a forced pre-heating step to elevate the material's temperature (and hence lower the flow stress) to extrude the material through the die(s). Immediately prior to Conform™ extrusion, the rod stock is fed into the wheel at room temperature and the material undergoes tremendous shearing forces which rapidly elevates the temperature of the material just prior to extrusion through the die. The duration of this is very short vs. the pre-heat time employed in a billet extrusion process, hence giving the material little time to precipitate solute. This advantage, when coupled with rod stock of the appropriate chemistry and processing history, can be used to produce certain products that have high strength through solute strengthening and/or a fine dispersion of particles. In addition the electrochemical properties of final products can be appropriately tailored for the application by introducing some alloying elements into the stock material at certain levels.

The Conform™ extrusion production process is continuous such that it greatly minimizes transverse welds, reduces possible contamination often associated with butt shearing and related pin hole leaks at billet change compared to billet extrusion, and increases recoveries. In addition, the die face pressure remains consistent, which should result in less tool wear, consistent die deflection, better dimensional tolerances, and high quality. Moreover the one-feedstock and one-extruded product process (i.e. one out process) leads to possible inline integration of other process such as flash anneal, coating, cut to length, etc.

The high strength aluminum alloys with yield strength greater than about 50 MPa that may be used in this invention would include several of the Aluminum Association's designated 1XXX, 2XXX, 3XXX, 4XXX, 5XXX, 6XXX, 7XXX and 8XXX series of aluminum alloys. Other aluminum alloys that may be used with this invention would include the alloys disclosed in U.S. Pat. Nos. 6,660,107; 6,656,296; 6,602,363; 6,503,446; 6,458,224; and 5,976,278, the contents of which are incorporated herein by reference.

This invention may also be used to produce a clad tube product by use of, but not limited to, a tangential continuous rotary extrusion process. Depending upon the final application the clad tube can be formed with high strength aluminum alloy tube cladded with a layer of 1XXX, 2XXX, 3XXX, 4XXX, 5XXX, 6XXX, 7XXX, or 8XXX series of aluminum alloy on the exterior surface of the tube. This cladding can be subjected to a sinking or drawing ad/or an elevated thermal process (e.g. an annealing operation) to further enhance the adhesion of the cladding to the lube.

The invention also describes a method of making a heat exchanger tube that includes continuously casting a feed stock and extruding the feed stock through a continuous extrusion rotary process to form a heat exchanger tube.

In one embodiment of this method, the heat exchanger tube is quenched or air cooled after extrusion.

An aspect of this invention is to provide improved heat exchanger tubing that exhibits high strength, excellent corrosion resistance, and improved mechanical properties along with good formability, brazeability, fatigue performance and improved service life.

Another aspect of this invention is to produce micro multi void tubing exhibiting high strength, excellent corrosion resistance, and improved mechanical properties as along with good formability brazeability and improved service life.

Another aspect of this invention is to produce small dimension tubing that exhibits high strength, excellent corrosion resistance, and improved mechanical properties with good formability, fatigue resistance, brazeability, and improved service life.

Another aspect of this invention is to produce clad tube products with high strength aluminum alloy and a clad layer or layers for corrosion resistance improvement.

Another aspect of this invention is to produce clad tube products with an outer layer of braze filler alloy such that bare fin products can be used in the manufacture of heat exchangers.

DETAILED DESCRIPTION OF PREFERRED EMBODIMENTS

Figure 1:
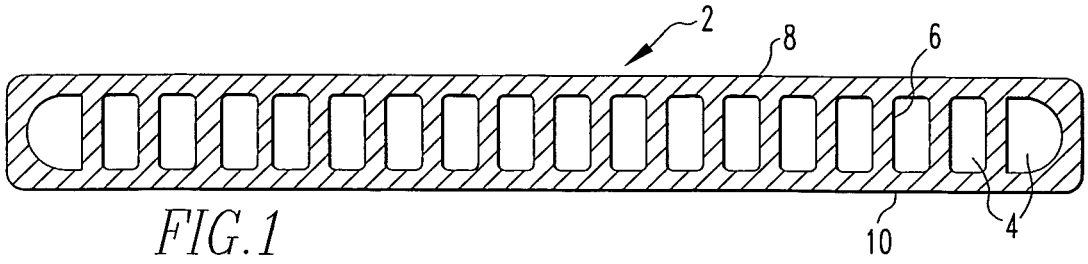
FIG. 1 is a cross section of a multi void heat exchanger tube.

The accompanying drawings and the description which follows set forth this invention in its preferred embodiments. However, it is contemplated that persons generally familiar with extrusion processes will be able to apply the novel characteristics of the structures and methods illustrated and described herein in other contexts by modification of certain details. Accordingly, the drawings and description are not to be taken as restrictive on the scope of this invention, but are to be understood as broad and general teachings. When referring to any numerical range of values, such ranges are understood to include each and every number and/or fraction between the stated range minimum and maximum. For purposes of the description hereinafter, the terms "upper", "lower", "right", "left", "vertical", "horizontal", "top", "bottom", and derivatives thereof shall relate to the invention as it is oriented in the drawing figures.

This invention solves the difficulty of extruding a high strength alloy into a smaller, more complex structure by extruding a feedstock alloy of carefully selected chemistry and process history through a continuous rotary extrusion process. This extrusion process is known in the metal fabricating industry as the Conform™ Process, but applications of the process using high strength alloys to produce complex tubing structures is unknown. The Conform™ Process is described in U.S. Pat. No. 3,765,216, the contents of which are incorporated herein by reference. This process includes the steps of feeding metal, powder, or feedstock rod into one end of a passageway formed between first and second members, with the second member having a greater surface area for engaging the material than the first member. The passageway is blocked at one end, remote from the feeding end, and has at least one die orifice associated with the blocked end. The moving of the passageway-defining surface of the second member relative to the passage-defining surface of the first member in a direction towards the die orifice from the first end to the blocked end is such that the frictional drag of the passageway-defining surface of the second member draws the material through the passageway and generates in it a pressure that is sufficient to extrude it through the die orifice.

The advantage of using the Conform™ process to produce a small dimensional tube is three fold. First, by using the Conform™ Process a high strength feedstock alloy can be used to produce the heat exchanger tube. This advantage is possible because the feedstock in the Conform™ Process is most typically, a continuous cast rod that is smaller in diameter than a billet. The smaller diameter of the continuous cast rod significantly reduces the extrusion ratio which in turn reduces the pressure necessary to extrude the desired product and the continuous nature of the process results in relatively constant die face pressure. Therefore, the Conform™ process allows a small size tube to be extruded using a high strength alloy. The second advantage that the Conform™ process presents is that it is cost competitive for certain difficult to extrude profiles and has the advantage of being a continuous process. The continuous process generally has high productivity and high recoveries (typically 5% process scrap or less) which in turn helps to keep the production costs competitive. Finally, by using the continuous rotary extrusion process, a non-homogenized or homogenized cast feedstock of high solute level may be used to extrude a tube that has improved strength properties and/or corrosion properties, which offers alloy design flexibility in chemistry and processing history of alloy.

It is a great advantage to achieve improved strength properties of the extruded tube by exploiting higher solute alloys, particularly continuous cast high solute alloys and having the metallurgical flexibility of using homogenized or non homogenized feedstock rod. Extruding a micro multi void tube using a non-homogenized cast billet through traditional press extrusion methods would be extremely difficult due to the high extrusion pressure that would be needed to extrude the desired product. Unlike extruding a product with a press extrusion method, the Conform™ Process requires a lower extrusion pressure since the Conform™ Process has a lower extrusion ratio. Because the Conform™ Process requires lower extrusion pressure, it is possible to extrude a small dimensional tube from a high flow stress material (e.g. a non-homogenized cast rod or high solute level alloy). By using the continuous rotary extrusion process in combination with high strength aluminum alloys and microstructures, this invention allows heat exchanger tubing to be produced with a high strength alloy while being efficient and cost competitive from a manufacturing perspective.

TABLE 1

Metallurgical Composition of the Aluminum Alloys

| Si | Cu | Mn | Fe | Zn | Ti | | Cr | Zr | V | Co | Mg | Ni |
|---|---|---|---|---|---|---|---|---|---|---|---|---|
| about 0.01-1.5% | up to about 1.2% | up to about 2.0% | about 0.01-1.0% | up to about 5.0% | up to about 0.02% | Balance substantially aluminum and incidental elements and impurities | — | — | — | — | — | — |
| about 0.01-1.5% | up to about 1.2% | up to about 2.0% | about 0.01-1.0% | up to about 5.0% | up to about 0.02% | Balance substantially aluminum and incidental elements and impurities | about 0.01-0.35% | about 0.01-0.35% | about 0.01-0.35% | about 0.01-0.35% | up to about 1.0% | about 0.01-2.5% |
| about 0.01-1.5% | up to about 1.2% | up to about 2.0% | about 0.01-1.0% | up to about 5.0% | about 0.02-0.35% | Balance substantially aluminum and incidental elements and impurities | — | — | — | — | — | — |

TABLE 1-continued

| Metallurgical Composition of the Aluminum Alloys | | | | | | | | | | | | |
|---|---|---|---|---|---|---|---|---|---|---|---|---|
| Si | Cu | Mn | Fe | Zn | Ti | | Cr | Zr | V | Co | Mg | Ni |
| about 0.01-1.5% | up to about 1.2% | up to about 2.0% | about 0.01-1.0% | up to about 5.0% | about 0.02-0.35% | Balance substantially aluminum and elements and impurities | about 0.01-0.35% | about 0.01-0.35% | about 0.01-0.35% | about 0.01-0.35% | up to about 1.0% | about 0.01-2.5% |
| about 0.01-1.0% | up to about 1.0% | up to about 1.8% | about 0.05-0.8% | up to about 2.0% | up to about 0.02% | Balance substantially aluminum and incidental elements and impurities | — | — | — | — | — | — |
| about 0.01-1.0% | up to about 1.0% | up to about 1.8% | about 0.05-0.8% | up to about 2.0% | up to about 0.02% | Balance substantially aluminum and incidental elements and impurities | about 0.01-0.30% | about 0.01-0.30% | about 0.01-0.30% | about 0.01-0.30% | up to about 0.08% | about 0.01-2.0% |
| about 0.01-1.0% | up to about 1.0% | up to about 1.8% | about 0.05-0.8% | up to about 2.0% | about 0.02-0.30% | Balance substantially aluminum and incidental elements and impurities | — | — | — | — | — | — |
| about 0.01-1.0% | up to about 1.0% | up to about 1.8% | about 0.05-0.8% | up to about 2.0% | about 0.02-0.30% | Balance substantially aluminum incidental elements and impurities | about 0.01-0.30% | about 0.01-0.30% | about 0.01-0.30% | about 0.01-0.30% | up to about 0.08% | about 0.01-2.0% |
| about 0.01-0.50% | up to about 0.7% | up to about 1.5% | about 0.10-0.7% | up to about 1.5% | up to about 0.02% | Balance substantially aluminum and incidental elements and impurities | — | — | — | — | — | — |
| about 0.01-0.50% | up to about 0.7% | up to about 1.5% | about 0.10-0.7% | up to about 1.5% | up to about 0.02% | Balance substantially aluminum and incidental elements and impurities | about 0.01-0.28% | about 0.01-0.28% | about 0.01-0.28% | about 0.01-0.28% | up to about 0.08% | about 0.01-1.8% |
| about 0.01-0.50% | up to about 0.7% | up to about 1.5% | about 0.10-0.7% | up to about 1.5% | about 0.02-0.25% | Balance substantially aluminum and incidental elements and impurities | — | — | — | — | — | — |
| about 0.01-0.50% | up to about 0.7% | up to about 1.5% | about 0.10-0.7% | up to about 1.5% | about 0.02-0.25% | Balance substantially aluminum and incidental elements and impurities | about 0.01-0.28% | about 0.01-0.28% | about 0.01-0.28% | about 0.01-0.28% | up to about 0.08% | about 0.01-1.8% |

Table 1 discloses the metallurgical compositions of the aluminum alloys that can be used to fabricate a heat exchanger tube in accordance with this invention. One skilled in the art would also appreciate that the heat exchanger tube can have one or more clad layers cladded over an exterior surface of the tube. The clad layer can be selected from the Aluminum Association's 1XXX, 2XXX, 3XXX, 4XXX, 5XXX, 6XXX, 7XXX, or 8XXX series of aluminum alloys.

FIG. 1 is a cross section of a multi void heat exchanger tube. FIG. 1 depicts a multi void tube 2 having a plurality of parallel flow channels 4 that are separated by a web(s) or wall(s) 6 that are aligned along the longitude of the tubing or generally perpendicular to the opposing surfaces 8 and 10. As can be seen in FIG. 1, the flow channels 4 are substantially rectangular. However, one skilled in the art would appreciate that the cross section of the flow channels 4 can have other shapes (e.g., square, circular, oval, or other regular or irregular shapes). The inner walls of the channels 4 can be smooth or rough. In making a heat exchanger, the tubes 2 are joined to corrugated fins (not shown) using a brazing process. Both multi void and micro multi void tubing 2 are about 10-25 mm in width and about 1-2 mm in height.

A high strength heat exchanger tube will soon be required as the industry adopts carbon dioxide as the standard coolant for heat exchanger systems since carbon dioxide heat exchangers operate at higher pressures than heat exchangers that utilize Freon. By using continuous casting and the Conform™ Process a heat exchanger tube can be produced with both high strength and improved corrosion resistant and service life, which will be in great favor of future automotive heat exchanger applications. A heat exchanger tube formed from a high strength and corrosion resistant aluminum alloy would not only meet the increasing demands for the new generation heat exchangers, but provide better service life and durability as well for automotives encountering salt and snow during the winter months, automobiles located in or near costal areas with high sodium chloride levels in the air, and potential corrosion from other elements or materials that might be mixed with rain water.

Figure 2:
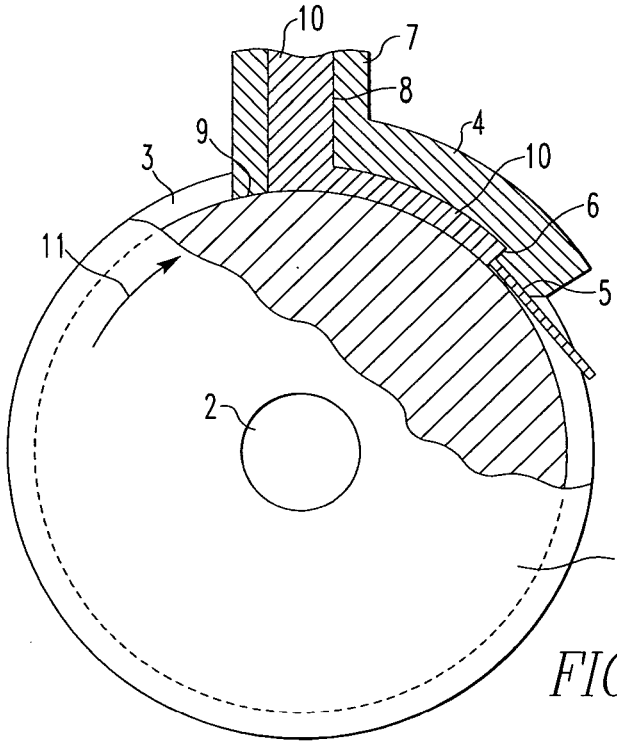
FIG. 2 is one embodiment of a continuous rotary extrusion apparatus.

FIG. 2 is one example of a continuous rotary extrusion apparatus, also known as the Conform™ Process. The extrusion apparatus comprises a wheel 1 rotate-ably mounted on a shaft 2. The wheel 1 has a groove 3 machined around its outer edge about the axis of the wheel. A shoe member 4 fits closely against the edge of the wheel 1. An abutment member 5 formed on the underside of the shoe member 4 projects into the groove 3 and is complementary in shape to the groove cross section so as to block the groove with a sliding fit. The abutment member 5 has an extrusion orifice 6. A chamber 7 integrally formed with the shoe member 4 has a bore 8 connected with the groove 3 in the wheel 1. A sealing block 9 formed on the underside of the shoe member 4 at the opposite end to the abutment member 5 projects into and is close sliding fit in the circumferential groove 3 in the wheel 1.

The wheel 1 is rotated clockwise as shown by the arrow 11 in FIG. 2. The material 10 in the groove 3 beneath the shoe member 4 is carried forward towards the abutment member 5 by the frictional drag of the walls of the groove 3. Thus pressure is generated in the material in the groove 3, so that the material is extruded through the orifice 6 in the abutment ember 5. Also the rotation of the wheel 1 drags material under a transverse shearing action from the bore 8 of the chamber 7 so that a continuous extrusion of the material is obtained.

Figure 3:
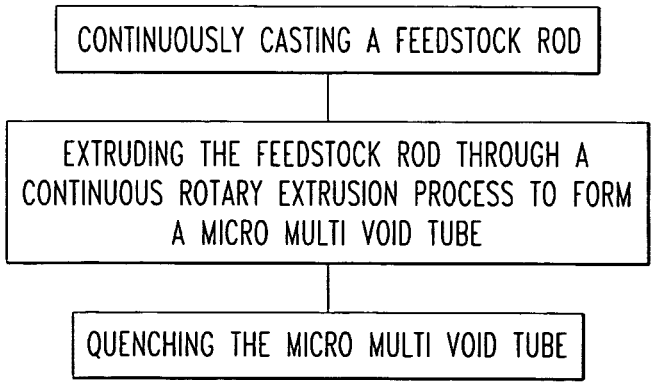
FIG. 3 is a flowchart depicting one embodiment of the present invention.

FIG. 3 is a flowchart depicting one preferred embodiment of the inventive method. As can be understood from FIG. 3, the continuously cast feedstock rod is formed by cooling molten metal into a bar shape, which is continuously formed into a rod by a number of rollers following initial cooling. The feedstock rod is then fed into a groove located on a rotating wheel and extruded through the extrusion die to form the micro multi void tubes. After extrusion, the micro multi void tubes can then be quenched using techniques that are commonly known in the art such as water or air cooling.

Figure 4:
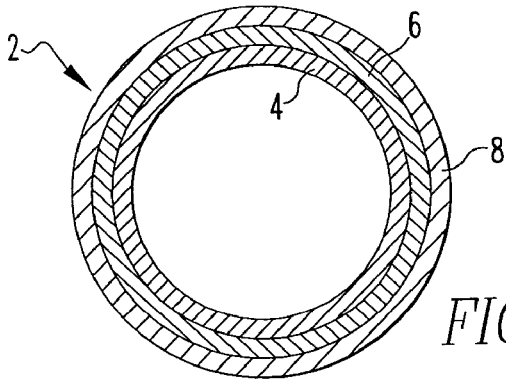
FIG. 4 is a three-layer round tube with clad on both inside and outside of the tube.

FIG. 4 shows an example of a multi layer round tube 2. The multi layer tube 2 has an inner core tube 4, an intermediate layer 6, and an outer layer 8. In one application, the inner core tube 4 and the outer layer 8 are anodic (at least 20 mV more negative) to intermediate layer 6 such that the two layers enhance the corrosion resistance of the tube. However, the intermediate layer 6 can be a high strength alloy. In another application the outer layer 8 is made of a 4XXX aluminum alloy cladding for braze, the inner core tube 4 has a high magnesium content (up to 2%) for high strength, and the intermediate layer 6 has a low magnesium (up to 0.15%) content, ideally less than 0.05%, to enhance the brazeability.

Figure 5:
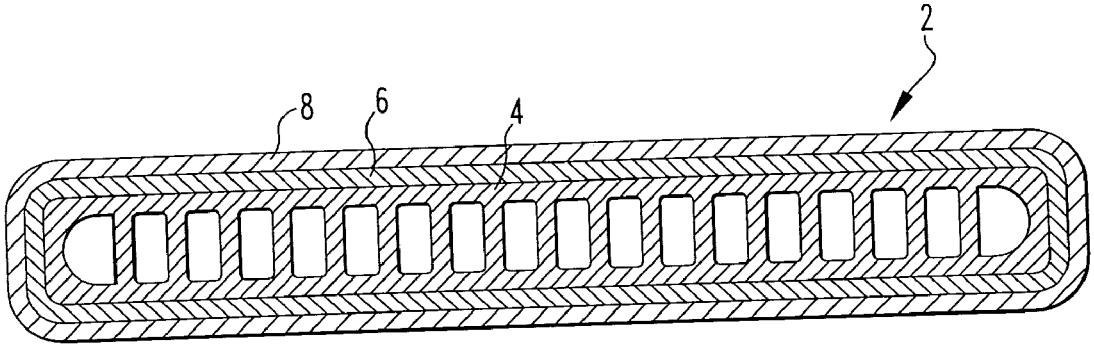
FIG. 5 is a three-layer micro multi void tube with clad both inside and outside tube.

FIG. 5 depicts a multi layer micro multi void tube 2. The multi layer micro multi void tube 2 has an inner core tube 4, an intermediate layer 6, and an outer layer 8. In one application the inner core tube 4 and the outer layer 8 are anodic (at least 20 mV more negative) to intermediate layer 6 such that the two layers enhance the corrosion resistance of the tube. However, the intermediate layer 6 can be a high strength alloy. In another application the outer layer 8 is made of a 4XXX series aluminum alloy cladding for braze, the inner core tube 4 has a high magnesium content (up to 2%) for high strength, and the intermediate layer 6 has a low magnesium (up to 0.15%) content, ideally less than 0.05%, to enhance the brazeability.

Figure 6:
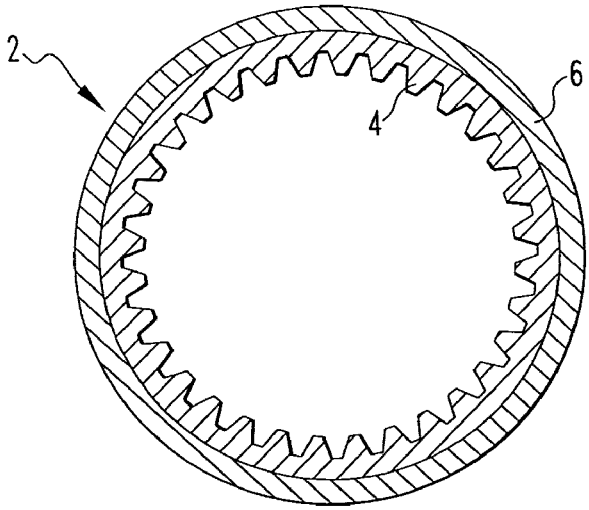
FIG. 6 is an enhanced round tube with a clad layer on the outside tube.

FIG. 6 depicts a round tube 2 with an inner core 4 and an outer layer 6. The outer layer 6 is used for applications such as braze or corrosion improvement. However, it is noted that one skilled in the art would recognize that the outer layer might be used for other applications as well yet still fall within the scope of this invention. The inner core 4 can be fabricated from a high strength alloy which can withstand high burst pressures and which exhibits enhance heat transfer properties.

Figure 7A:
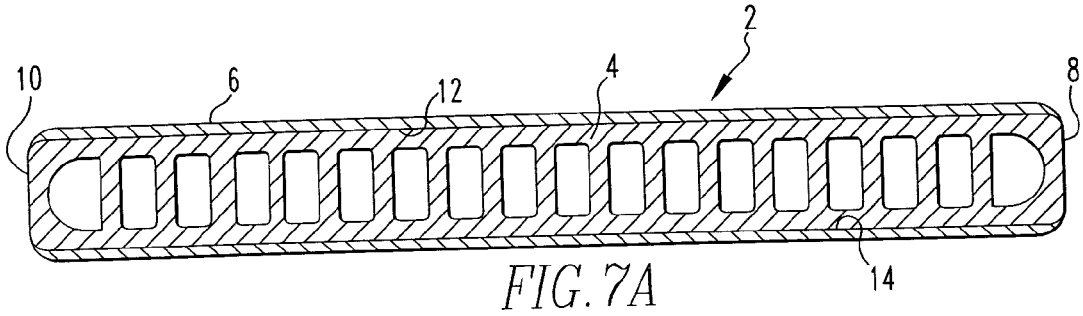
FIGS. 7*a* and 7*b* are a micro multi void tube with a clad layer.
Figure 7B:
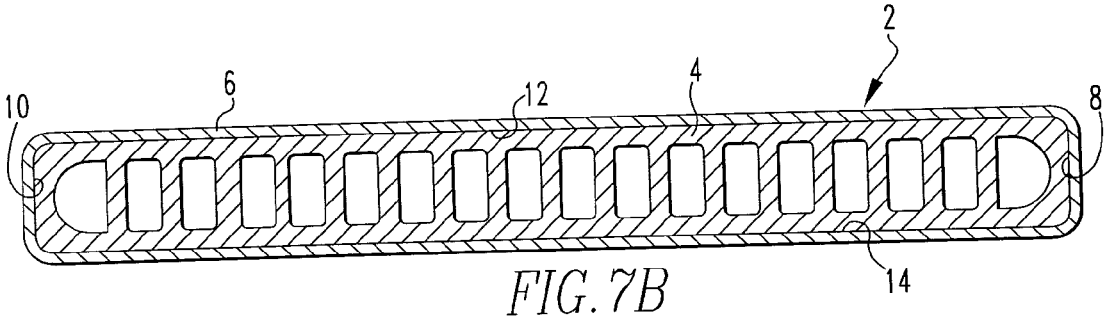
Figure 8:
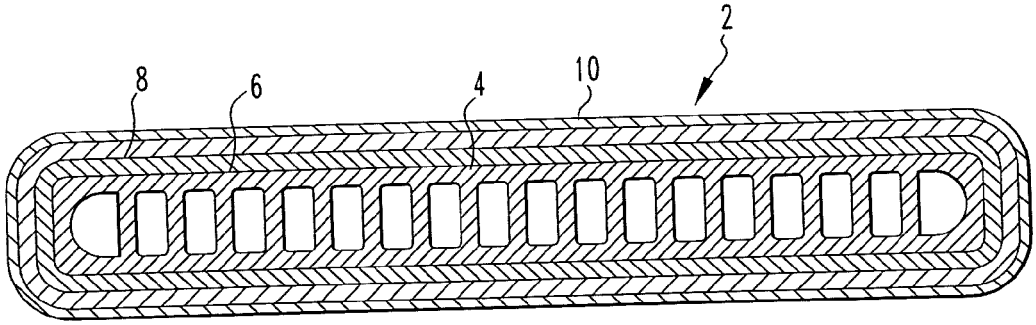
FIG. 8 is a four-layer micro multi void tube.

FIGS. 7*a* and 7*b* show a two layer micro multi void tube 2 having an inner core 4 and an outer layer 6. The inner core has a first end 8, a second end 10, an upper surface 12, and a lower surface 14. As depicted in FIG. 7*a*, the outer layer 6 can be made to cover only the upper surface 12 and the lower surface 14 of the inner core 4 while excluding the first end 8 and the second end 10. FIG. 7*b* depicts the outer layer 6 as covering the entire inner core 4 including the first and second ends 8 and 10.

FIG. 5 is an example of four layer micro multi void tube 2 having an inner core 4, a first intermediate layer 6, a second intermediate layer 8, and an outer layer 10. Each of the layers are designed for a specific property requirement. For example, some properties that might be desirable would include, but shall not be limited to, high strength, high corrosion resistance, solute diffusion control, and improved brazeability.

TABLE 2

Pre and Post Braze Tensile Properties of MMV Tubing

| Alloy | Feedstock | Homogenization | Tubing Design | Pre Braze Tensile (MPa) | Pre Braze Yield (MPa) | Pre Braze Elong (%) | Post Braze Tensile (MPa) | Post Braze Yield (MPa) | Post Braze Elong (%) |
|---|---|---|---|---|---|---|---|---|---|
| 1350 | Concast | No | MMV | 66.21 | 37.13 | 50.3 | 57.93 | 16.21 | 35.3 |
| High Strength Alloy | Concast (A) | No | MMV | 97.47 | 69.43 | 40.3 | 91.72 | 34.02 | 47.7 |
| High Strength Alloy | Extruded from a DC Cast Billet (B) | Yes | MMV | 91.72 | 51.95 | 43.1 | 90.00 | 30.23 | 37.4 |

In Table 2, the high strength alloys are the same aluminum alloy and were selected from the 3XXX series of aluminum alloys. The high strength aluminum alloy consisted essentially of about 0.01-1.0% silicon, up to about 0.70% copper, up to about 2.0% manganese; about 0.01-1.0% iron, about 0.01-5.0% zinc; about 0.01-0.35% titanium, balance substantially aluminum and incidental elements and impurities. Aluminum alloy 1350 was used as a control material.

High Strength Alloy Concast (A) and the 1350 aluminum alloy were formed into feedstock rods by a continuous casting process. The feedstock rods were then extruded into various micro multi void tubes (MMV) through the Conform™ Process. In contrast, High Strength Alloy DC Cast Billet (B) was extruded into a feedstock rod by using a traditional press extrusion method with a DC cast billet. The extruded feedstock rod was then extruded into MMV tubes through the Conform™ Process. The Conform™ Process bad an extrusion ratio of 4 as compared to traditional press extrusion which as an extrusion ratio 450. Table 2 shows that when the high strength aluminum ahoy is extruded through the Conform™ Process with a feedstock rod that was continuously cast and not homogenized, the extruded tube exhibited equal or higher pre and post brazed strength properties when compared to DC Cast Billet (B).

The results in Table 2 were unexpected results since one would not expect that a non-homogenized high strength alloy could be extruded to a small size MMV tube meeting all the dimensional and surface quality requirements. In addition, Table 2 shows that when the feedstock rod was formed by continuous casting (Concast (A)), the extruded MMV tube exhibited improved tensile properties over an MMV tube that was formed from a feedstock rod that was extruded from a DC cast billet using traditional press extrusion methods (DC Cast Billet (B)). For example, Table 2 shows that the Pre-braze tensile strength of the MMV tube that was formed by continuous casting (Concast (A)) had a tensile strength of 97.47 MPa, which is a 6% increase in tensile strength when compared to the MMV that was extruded DC Cast Billet (B), and a yield strength of 69.43 MPa, which is a 25% increase in yield strength when compared to the MMV that was extruded using DC Cast Billet (B). Table 2 also shows that the pre braze MMV had a 40.3% elongation. The post braze MMV that was formed by continuous casting (Concast (A)) had a tensile strength of 91.72 MPa, which is a 2% increase in tensile strength when compared to the MMV that was extruded using DC Cast Billet (B), a yield strength of 34.02 MPa, which is an 11% increase in yield strength when compared to the MMV that was extruded using DC Cast Billet (B), and an elongation of 47.7%, which is a 22% increase in elongation when compared to the MMV that was extruded using DC Cast Billet (B). Therefore, a heat exchanger tube exhibiting improved tensile properties can be manufactured by using the Conform™ Process in combination with feedstock rod formed by continuous casting.

Since High Strength Alloy Concast (A) exhibited improved tensile properties over High Strength Alloy DC Cast Billet (B), Table 2 is an indication (for dispersion strengthened or age hardened or solute strengthened alloys) that the tensile properties of heat exchanger tubing (of like chemistry) that is extruded through a combination of continuous casting and the Conform™ Process would be greater than the tensile properties of tubing that is extruded using a billet and traditional press extrusion methods. This conclusion can be asserted because the microstructure of the extruded feedstock rod was substantially similar to that of the original billet and both the Conform™ Process and the traditional press extrusion is believed to have substantially similar metal temperatures and metal flow at the moment the metal is being extruded through the extrusion die. Therefore, it is reasonable to conclude that heat exchanger tubes extruded using the Conform™ Process would exhibit improved tensile properties over heat exchanger tubes that are extruded using a billet and traditional press extrusion methods.

TABLE 3

Corrosion Test (SWAAT) Results (number passed over total number tested)

| Alloy | Rod Stock | Design Code | 10 Days | 20 Days | 30 Days |
|---|---|---|---|---|---|
| 1350 | Concast | MMV | 14/15 | 6/15 | 0/15 |
| High Strength Alloy | Concast (A) | MMV | 15/15 | 15/15 | 15/15 |
| High Strength Alloy | Extruded from a DC Cast Billet (B) | MMV | 15/15 | 15/15 | 15/15 |
| High Strength Alloy | Billet (C) | Production | — | 5/5 | 5/5 |

Table 3 shows the number of extruded tubes that passed the SWAAT test in the braze condition. The SWAAT test used was the American Society for Testing and Materials (ASTM) G85 A3. The high strength alloy was selected from the 3XXX series of aluminum alloys. The high strength aluminum alloy consisted essentially of about 0.01-1.0% silicon, up to about 0.70% copper, up to about 2.0% manganese; about 0.01-1.0% iron, about 0.01-5.0% zinc; about 0.01-0.35% titanium, balance substantially aluminum and incidental elements and impurities. Aluminum alloy 1350 was used as a control material and the feedstock rod was extruded using a continuous casting process.

High strength alloy continuous cast (Concast) (A), high strength alloy direct chill (DC) cast billet (B), and aluminum alloy 1350 were extruded into heat exchanger tubing using the Conform™ Process. High strength alloy billet (C) was extruded into heat exchanger tubing by using traditional press extrusion methods. Table 3 shows that the tubes extruded by the Conform™ Process with the high strength aluminum alloy exhibited similar corrosion resistance properties as compared to the tubes that were extruded with a billet by traditional press extrusion methods. As expected, the corrosion resistance of the high strength alloy was superior to that of the control 1350 aluminum alloy. Table 3 shows that the Conform™ Process can be used to produce a heat exchanger tube with identical anti-corrosive properties as that of a tube that is produced using traditional press extrusion methods.

TABLE 4

Surface Roughness Test Results of Experimental MMV Tubing

| Alloy-Sample ID | Rod Stock | Design Code | $R_a$ (μm) | $R_q$ (μm) | $R_p$ (μm) | $R_v$ (μm) | $R_t$ (μm) | $R_z$ (μm) | $R_{max}$ (μm) |
|---|---|---|---|---|---|---|---|---|---|
| 1350-B23B | Concast | MMV | Pass | Pass | Pass | Pass | Pass | Pass | Pass |
| High Strength Alloy | Concast (A) | MMV | Pass | Pass | Pass | Pass | Pass | Pass | Pass |
| High Strength Alloy | Extrude from a DC Cast Billet (B) | MMV | Pass | Pass | Pass | Pass | Pass | Pass | Pass |
| Commercially Acceptable Standards | | | 10 | 10 | 10 | 10 | 10 | 10 | 10 |

Table 4 shows the pre braze surface roughness measurements of the tubes that were extruded using the Conform™ Process. As with the previous trials, the high strength alloy was selected from the 3XXX series of aluminum alloys. Aluminum alloy 1350 was used as a control material. All of the alloys were extruded into a micro multi void (MMV) tube. The measurements were taken normal to the extrusion direction and the measurements include the following: $R_a$—roughness average, $R_q$—root mean squared roughness average, $R_p$—maximum peak height, $R_v$—maximum valley depth, $R_t$—maximum roughness depth, $R_z$—mean peak-to-valley height, and $R_{max}$—Maximum peak-to-valley height.

Table 4 shows that the tubes that were extruded using the Conform™ Process exceed the current commercially acceptable standards in the relevant industry. This result was the same regardless if the feedstock rod was formed by continuous casting or by extrusion by a DC cast billet. Therefore, a heat exchanger tube with small dimensions and improved tensile properties can be produced using the Conform™ Process with surface roughness equivalent to that of tubes extruded using traditional press extrusion methods.

Having described the presently preferred embodiments, it is to be understood that the invention may be otherwise embodied within the scope of the appended claims.

What is claimed is:

1. A heat exchanger tithe having improved resistance to high burst pressures, said heat exchanger tube comprising an aluminum alloy that consists essentially of about 0.01-1.5% silicon, tip to about 1.2% copper, tip to about 2.0% manganese, about 0.01-1.0% iron, up to about 5.0% zinc, tip to about 0.35% titanium, and the balance substantially aluminum and incidental elements and impurities, wherein said heat exchanger tube is formed from an aluminum alloy feedstock, said feedstock being a strip, rod, or sheet having an aspect ratio ranging from about 1:1 to 500:1, said feedstock may be exposed to elevated temperatures greater than about 300° C., said feedstock having an average secondary dendrite arm spacing less than about 100 microns and having a cross sectional area of about 2500 $mm^2$ or less and having a yield strength ranging from about 50 to about 150 MPa, and wherein said feedstock is extruded using a continuous rotary extrusion process into an extrusion.

2. The heat exchanger tube according to claim 1 wherein said extrusion is quenched or air cooled after extrusion.

3. The heat exchanger tube according to claim 1 wherein said aluminum alloy feedstock is continuously cast.

4. The heat exchanger tube according to claim 1 wherein said aluminum alloy further contains one or more of the following elements: about 0.01-0.35% chromium, about 0.01-0.35% zirconium, about 0.01-0.35% vanadium, about 0.01-0.35% cobalt, up to about 1.0% magnesium, and about 0.01-2.5% nickel.

5. The heat exchanger tube according to claim 1 wherein said tube further comprises a coating of at least about 80 wt % zinc.

6. The heat exchanger tube according to claim 1 wherein said tube has circumference less than about 400 mm.

7. The heat exchanger tube according to claim 1 wherein said tube is a micro multi void tube with a maximum height not exceeding about 5 mm.

8. The heat exchanger tube according to claim 1 wherein one or more walls of said tube has a wall thickness of less than about 1 mm.

9. The heat exchanger tube according to claim 1 wherein said tube has a post brazed tensile yield strength that exceeds about 35 MPa.

10. The heat exchanger tube according to claim 1 wherein said tube has a post brazed tensile yield strength that exceeds about 45 MPa.

11. The heat exchanger tube according to claim 1 wherein said tube can withstand a burst pressure greater than about 69 bar.

12. The heat exchanger tube according to claim 1 wherein said tube can withstand a burst pressure greater than about 69 bar post braze.

13. The heat exchanger tube according to claim 1 wherein said tube has an electric conductivity that is above about 48% IACS.

14. The heat exchanger tube according to claim 1 wherein said tube has a post-braze electric conductivity that is above about 48% IACS.

15. The heat exchanger tube according to claim 1 wherein the titanium ranges about 0.02% to about 0.35% titanium.

16. The heat exchanger tube according to claim 1 wherein said aluminum alloy further contains one or more of the following elements: up to about 0.8% magnesium, about 0.01-0.30% chromium, about 0.01-0.30% zirconium, about 0.01-0.30% vanadium, about 0.01-0.30% cobalt, and about 0.01-2.0% nickel.

17. The heat exchanger tube according to claim 1 wherein said aluminum alloy further contains one or more of the following elements: tip to about 0.8% magnesium, about 0.01-0.28% chromium, about 0.01-0.28% zirconium, about 0.01-0.28% vanadium, about 0.01-0.28% cobalt, and about 0.01-1.8% nickel.

18. The multi layered extruded tube according to claim 1, further comprising one or more clad layers comprising an aluminum alloy selected from the group consisting essentially of the 1XXX, 2XXX, 3XXX, 4XXX, 5XXX, 6XXX, 7XXX, and 8XXX series of aluminum alloys cladded on an exterior surface of said inner core.

19. The multi layered extruded tube according to claim 18 wherein an exterior surface of said extrusion is cladded with one or more clad layers by using one or more tangential continuous rotary extrusion machines.

20. The multi layered extruded tube according to claim 18 wherein said clad layers are drawn or sinked over said inner core tube after cladding.

21. The multi layered extruded tube according to claim 18 wherein said clad layer is selected from the group consisting essentially of aluminum alloys 4343, 4045, and 4047, said clad layer having a thickness ranging from about 3 μm to about 300 μm.

22. The multi layered extruded tube according to claim 18 wherein one clad layer has an electrochemical potential difference of at least about 20 mV to about 40 mM when compared to said inner core tube or an adjacent clad layer.

23. The multi layered extruded tube according to claim 18, wherein one or more tangential continuous rotary extrusion machines are used to clad one or more clad layers onto said exterior surface of said inner core tube.

* * * * *

UNITED STATES PATENT AND TRADEMARK OFFICE

CERTIFICATE OF CORRECTION

PATENT NO. : 7,732,059 B2
APPLICATION NO. : 11/157668
DATED : June 8, 2010
INVENTOR(S) : Baolute Ren, Raymond J. Kilmer and John F. Butler, Jr.

It is certified that error appears in the above-identified patent and that said Letters Patent is hereby corrected as shown below:

In claim 1, column 15, line 63, after "exchanger", delete "tithe" and insert -- tube --.

In claim 1, column 15, line 66, after "silicon,", delete "tip" and insert -- up --.

In claim 1, column 15, line 66, after "copper,", delete "tip" and insert -- up --.

In column 15, line 67, after "zinc,", delete "tip" and insert -- up --.

In column 17, line 17, after "elements:", delete "tip" and insert -- up --.

In column 18, line 12, after "consisting", delete "essentially".

Signed and Sealed this

Fifth Day of October, 2010

David J. Kappos

David J. Kappos
*Director of the United States Patent and Trademark Office*